US005794557A

United States Patent [19]

Geukens

[11] Patent Number: 5,794,557

[45] Date of Patent: Aug. 18, 1998

[54] STEERING DEVICE FOR A VESSEL

[75] Inventor: Frans Geukens, Malle, Belgium

[73] Assignee: Etap Yachting N.V., Belgium

[21] Appl. No.: 670,191

[22] Filed: Jun. 21, 1996

[30] Foreign Application Priority Data

Jun. 23, 1995 [NL] Netherlands ..... 1000654

[51] Int. Cl.[6] ..... B63H 25/10

[52] U.S. Cl. ..... 114/144 R; 114/159

[58] Field of Search ..... 114/154, 159, 114/144 R, 146, 162, 163, 39.1, 172

[56] References Cited

U.S. PATENT DOCUMENTS

| | | | |
|---|---|---|---|
| 305,741 | 9/1884 | Clemons | 114/159 |
| 1,021,267 | 3/1912 | Roe | 114/154 |
| 1,089,136 | 3/1914 | Kainer | 114/159 |
| 1,825,240 | 9/1931 | Miller | 114/144 R |
| 2,402,724 | 6/1946 | Bidwell | 114/144 R |
| 3,279,410 | 10/1966 | Young | 114/172 |
| 3,810,440 | 5/1974 | Johnson, Jr. | 114/144 R |
| 4,387,658 | 6/1983 | Elliott | 114/144 R |
| 5,170,734 | 12/1992 | Maguerez | 114/146 |

*Primary Examiner*—Sherman Basinger
*Attorney, Agent, or Firm*—Welsh & Katz, Ltd.

[57] ABSTRACT

The invention relates to a steering device for a vessel comprising at least one rudder arranged to pivot about a substantially vertically extending rudder pivoting axis and comprising at least one operating handle mounted on an operating handle pivot shaft extending in the longitudinal direction of the vessel, which operating handle is arranged to pivot in an imaginary plane extending substantially vertically and transversely to the longitudinal axis of the vessel, the operating handle being connected to the or each rudder via at least one coupling mechanism, so that a pivoting movement of the at least one operating handle causes a pivoting movement of the or each rudder about the rudder pivoting axis, wherein the or each coupling mechanism is formed by a set of cooperating gear segments, of which a first one is mounted on the or each rudder or a rudder pivot shaft connected thereto, and the second one is mounted on the at least one operating handle pivot shaft.

14 Claims, 4 Drawing Sheets

STEERING DEVICE FOR A VESSEL

FIELD OF THE INVENTION

This invention relates to a steering device for a vessel comprising at least one rudder arranged to pivot about a substantially vertically extending rudder pivoting axis and comprising at least one operating handle mounted on an operating handle pivot shaft extending in the longitudinal direction of the vessel, which operating handle is arranged to pivot in an imaginary plane extending substantially vertically and transversely to the longitudinal axis of the vessel, the operating handle being connected to the or each rudder via at least one coupling mechanism, so that a pivotal movement of the at least one operating handle causes a pivoting movement of the or each rudder about the rudder pivoting axis.

Such a steering device is known from U.S. Pat. No. 3,810,440. In this device, the operating handle comprises at a free end thereof a grip member, the arrangement being such that the operating handle is of substantially T-shaped configuration. The other end of the operating handle, is pivotally mounted on the deck of the vessel via an operating handle pivot. In the known device, the coupling mechanism between the rudder and the operating handle is formed by a tiller, known per se, which is arranged on the central portion of the steering post by means of a coupling element. Accordingly, the operation of the steering device according to this publication, where the operating handle merely constitutes a kind of extension member of the tiller, corresponds substantially with the operation of the tiller control, known per se, where the tiller is coupled directly to the rudder pivot shaft and pivots in an imaginary plane extending substantially horizontally. A pivotal movement of the tiller in one direction results in a change of direction of the vessel in an opposite direction.

A drawback of the known steering device is that the operating handle or tiller and the necessary pivoting sweep require a great deal of space. Owing to the tiller being coupled directly to the rudder pivot shaft, only a transmission of 1/1 is possible, which is disadvantageous, especially with larger boats and while going astern, in that the control force becomes too large. Also, the sitting posture requiring continuous turning of the head in the sailing direction is not ergonomic. A further disadvantage is that the tiller does not provide any hold for the operator in case of rough swell.

SUMMARY OF THE INVENTION

The object of the invention is to provide a solution to the above-described problem and to that effect the invention provides a steering device of the above-mentioned type, which is characterized in that the or each coupling mechanism is formed by a set of cooperating gear segments, of which a first one is mounted on the or each rudder or a rudder pivot shaft connected thereto, and the second one is mounted on the at least one operating handle pivot shaft, which operating handle pivot shaft is connected to the operating handle so as to be restrained from rotation.

By virtue of the features according to the invention, a steering device is provided which can be of particularly simple design and so can be designed economically and which further occupies little space. In addition, the steering device can be adapted to the wishes of the operator in a simple manner. Thus, the sailing direction with respect to the pivoting direction of the operating handle can be chosen freely and there is a possibility of different transmission ratios, which can reduce the required control force. Also, the position of the operating handle is not dependent on the coupling mechanism. Further, the operating handle provides a sufficient hold for the operator in heavy swell.

In the case where the gear segments are designed as conical gear segments, with the second gear segment meshing with an upwardly directed side of the first gear segment, a pivotal motion of the operating handle in one direction results in a change of direction of the vessel in the same direction.

The invention further relates to an operating handle evidently intended for a steering device according to the invention.

Further elaborations according to the invention are described in the subclaims and are further elucidated on the basis of an exemplary embodiment with reference to the drawings.

DETAILED DESCRIPTION OF THE INVENTION

Figure 1:
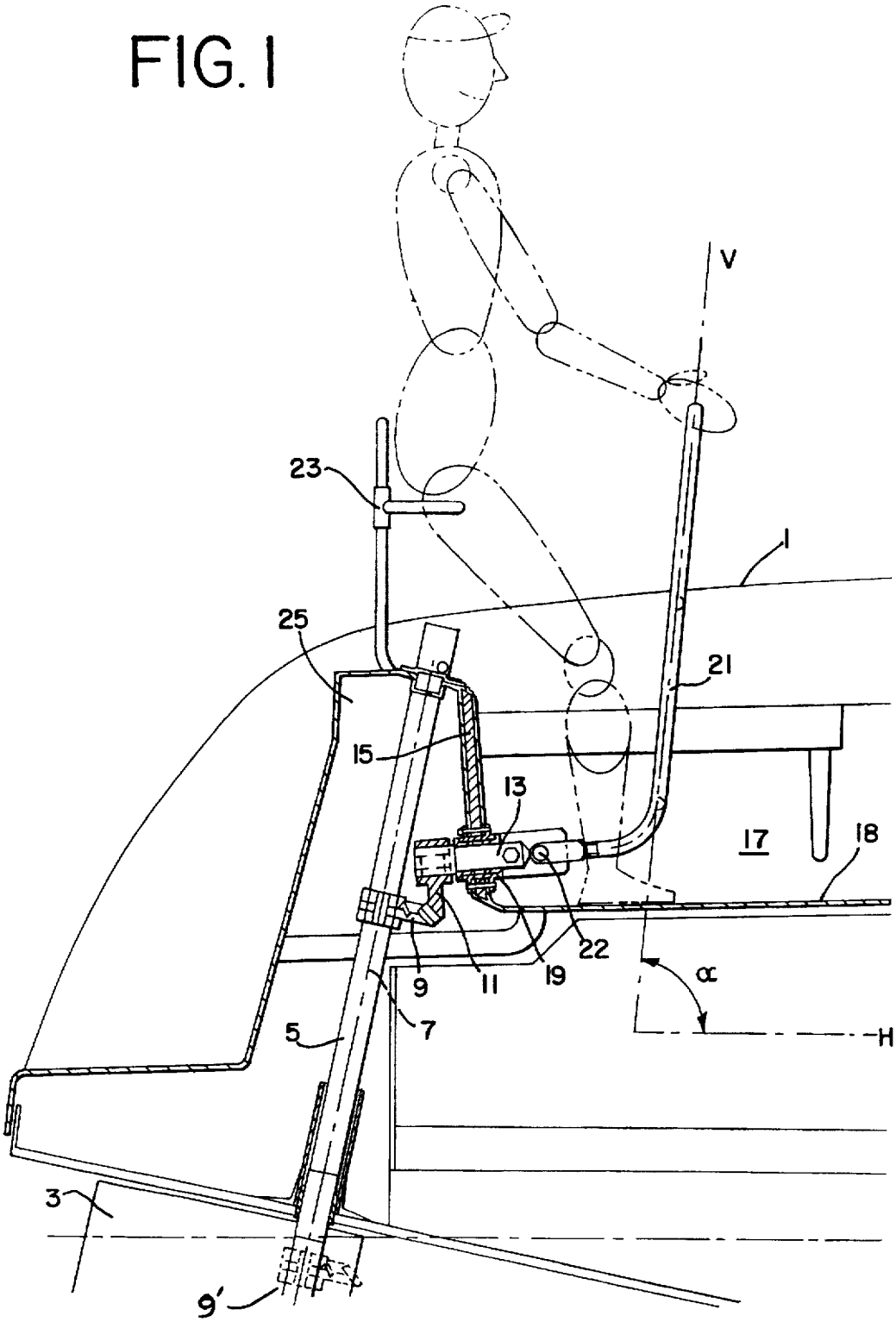
FIG. 1 is a side elevation of an exemplary embodiment of the steering device according to the invention.

In the drawings, equal parts are designated by the same reference numerals. FIG. 1 shows an exemplary embodiment of a steering device for a vessel 1. The vessel 1 comprises a rudder 3 capable of pivoting about a substantially vertically extending rudder pivoting axis 7 through a substantially vertically extending rudder pivot shaft 5. Mounted on the rudder pivot shaft 5 or on the rudder 3 itself in a known manner is a first gear segment 9 or 9' which by the upwardly directed side thereof meshes with a second gear segment 11. The gear segments in this case are designed as conical gear segments and are made of plastic, which damps vibrations in the transmission. The second gear segment 11 in turn is arranged on an operating handle pivot shaft 13 substantially extending in the longitudinal direction of the vessel and reaching through the cockpit rear wall 15 into the cockpit 17 of the vessel 1. The operating handle pivot shaft 13 is rotatably mounted in the hull wall 15 by means of a bearing 19. An operating handle 21 is arranged on the end of the operating handle pivot shaft 13 remote from the rudder pivot shaft 5, the arrangement being such that the operating handle 21 can be pivoted in an imaginary plane V extending substantially vertically and transversely to the longitudinal axis of the vessel 1, a pivotal motion P1, P2 of the operating handle 21 from the neutral position N (see FIG. 3) causing a turning of the operating handle pivot shaft 13, which in turn results in a pivotal motion of the rudder pivot shaft 5 and hence of the rudder 3. In such an arrangement of the gear segments 9, 11, a pivoting motion P1 of the operating handle 21 to the right, viewed in the sailing direction, results in the vessel 1 moving to the right. In the inverted arrangement of the gear segments 9, 11 relative to each other, that is, when the first gear segment 9 meshes with the upwardly directed side of the second gear segment 11, a pivotal motion of the operating handle 21 to the right P1, viewed in the sailing direction, causes a change of direction of the vessel 1 to the left. A further advantage of the use of the gear segments 9, 11 as a transmission mechanism is that in a simple manner, viz. by variation of the radius of the gear segments, different transmission ratios can be realized, depending on the dimensions of the vessel and/or on the wishes of the user.

The operating handle 21 can also be provided with a hinge fixable in different positions, the hinge pin 22 thereof being located in or adjacent the imaginary plane V and extending horizontally and perpendicularly to the longitudinal direction of the vessel, so that the angle α of the imaginary plane with respect to a horizontal plane H is adjustable, the arrangement being such that the operating handle 21 can be swung clear. In order to occupy even less space of the cockpit 17, the operating handle pivot shaft 13 can also extend under the cockpit bottom 18.

The device can also comprise a seat 23 for the operator of the vessel 1, which seat 23 is arranged on the afterdeck 25, so that, viewed in the longitudinal direction of the vessel, it is disposed behind the operating handle 21.

Figure 2:
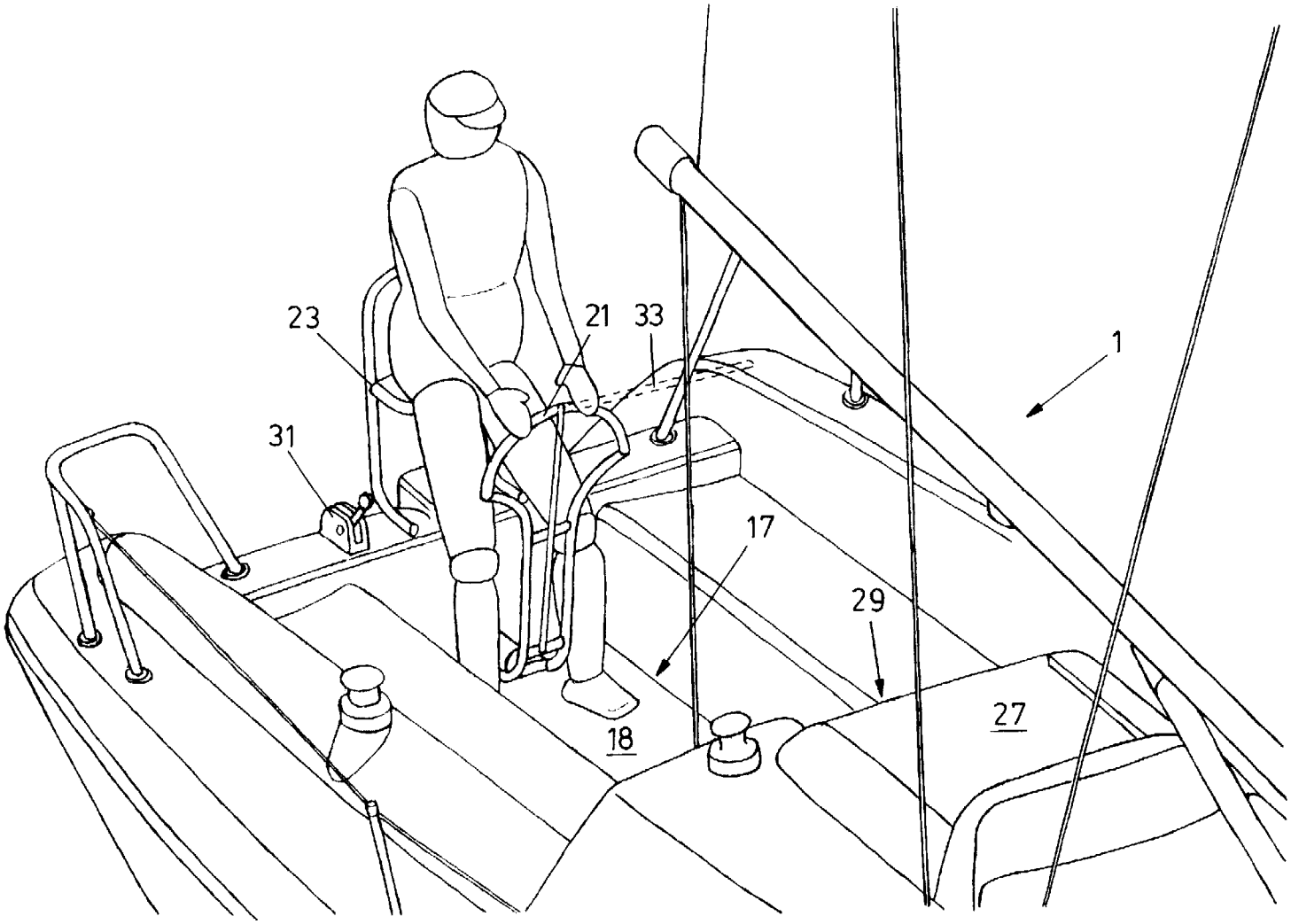
FIG. 2 is a perspective view of a cockpit of a sailboat with the operating handle arranged therein.

FIG. 2 shows a perspective view with a cockpit 17 and an operating handle 21 arranged therein. This view clearly shows the improved sitting posture of the helmsman with respect to the steering device according to the invention. By virtue of the seat 23 and the operating handle 21, the helmsman has a sufficient hold even in the case of heavy swell. Also, his body is turned in the sailing direction of the vessel 1 and he can easily look over the saloon roof 27 of the vessel 1. Also, in accordance with a further elaboration of the invention, the operating handle 21, as indicated schematically in FIG. 4, can be arranged at different positions in the cockpit 17, so that the helmsman can also stand or sit directly behind the saloon 29, for instance under the foul weather decking (not shown).

In the exemplary embodiment shown in FIG. 2, further an operating element 31 for a motor is arranged adjacent the seat 23. Owing to the motor operating element 31 being located within arm's reach of the helmsman it can be operated in a simple winner during the steering of the vessel 1.

In order to make it possible for the operating handle 21 to be remotely controlled and to be fixable in a position, the operating handle 21 can comprise an extension member or joystick 33 hinged to the operating handle 21.

Figure 3:
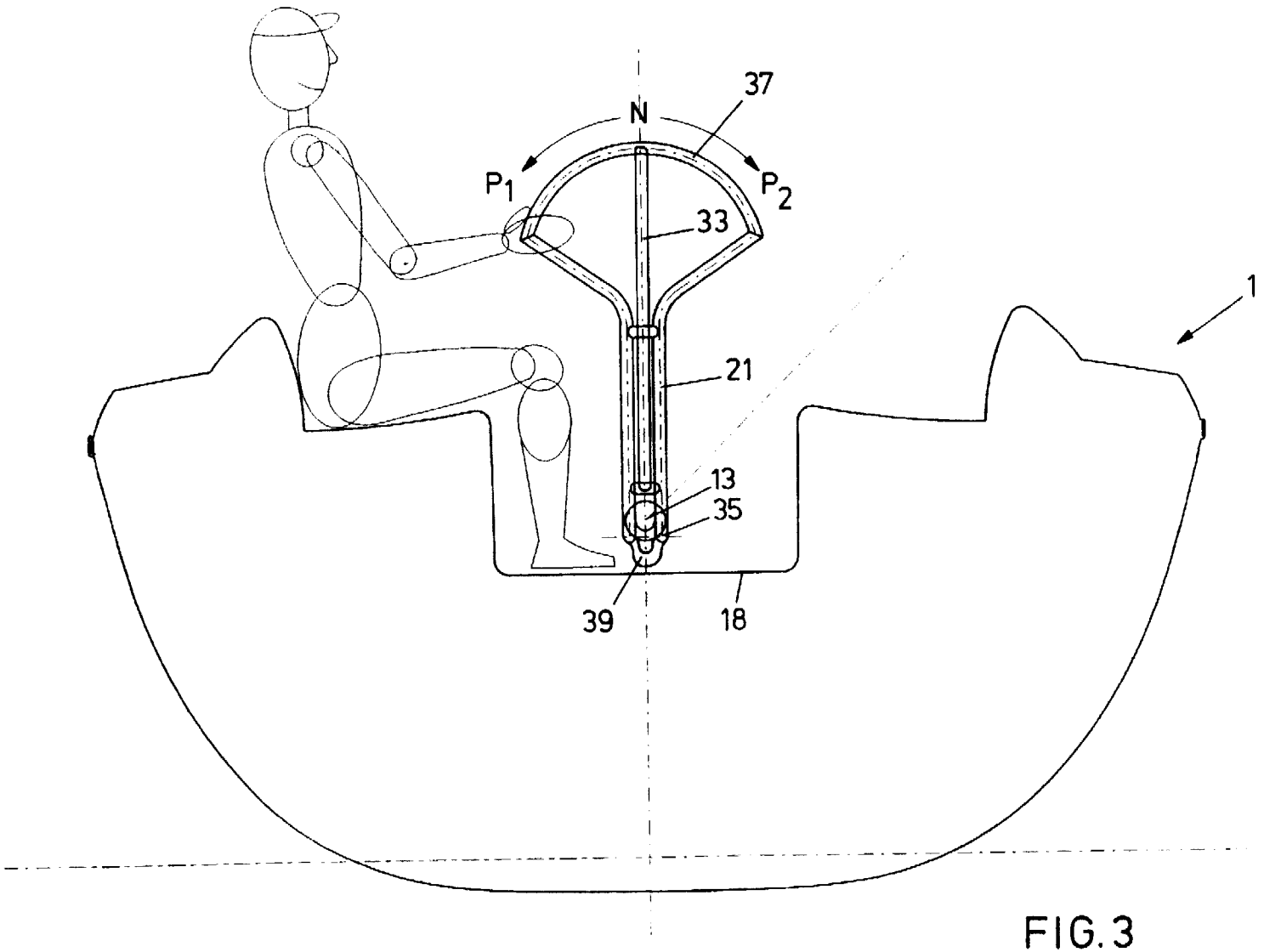
FIG. 3 is a cross section through the vessel with a front view of the operating handle.

FIG. 3 shows a cross section through the vessel 1 with a front view of the operating handle 21. The operating handle 21 is made from steel tubes, with the first end 35 being connected to the operating handle pivot shaft 13 and the second end being designed as a grip part 37 in the shape of a segment of a circle. As a result, a particularly ergonomic form of the operating handle 21 is obtained, which, as a result, can also be readily operated from the side of the vessel 1, as shown here. The joystick or the extension member 33 can be connected, for instance, to this circular segment-shaped grip part 37.

Figure 5:
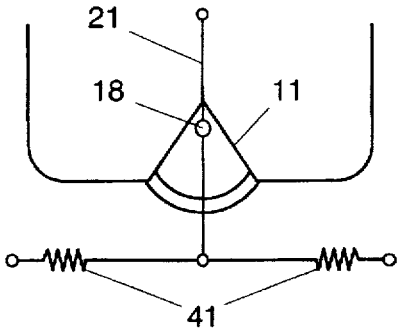
FIG. 5 is a schematic section in transverse direction through the vessel, with the operating handle being urged into the neutral position by springs.
Figure 6:
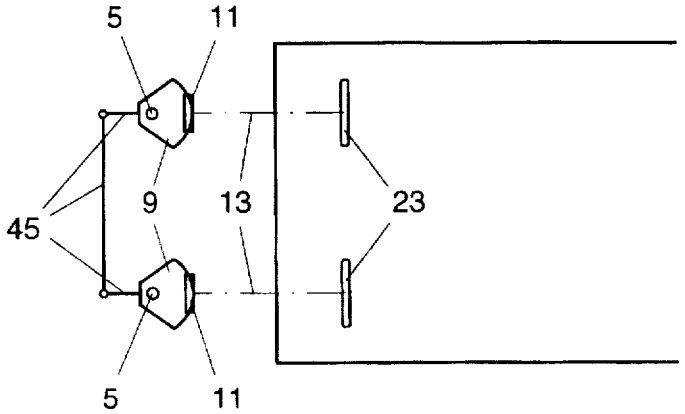
FIG. 6 is a schematic top plan view of the vessel with two rudders coupled to each other and two operating handles.

In order to urge the operating handle 21 and the rudder 3 into a neutral position, for instance in smooth water, which provides the option of releasing the operating handle 21, the steering device may comprise means for exerting a force on the steering device. As schematically represented in FIG. 3, these means can be formed, for instance, by a stabilizer weight 39 connected to the operating handle 21. As represented in FIG. 5, instead of or in addition to a stabilizer weight 39, the means can also comprise springs 41, which urge the operating handle 21 in the neutral position.

Figure 4:
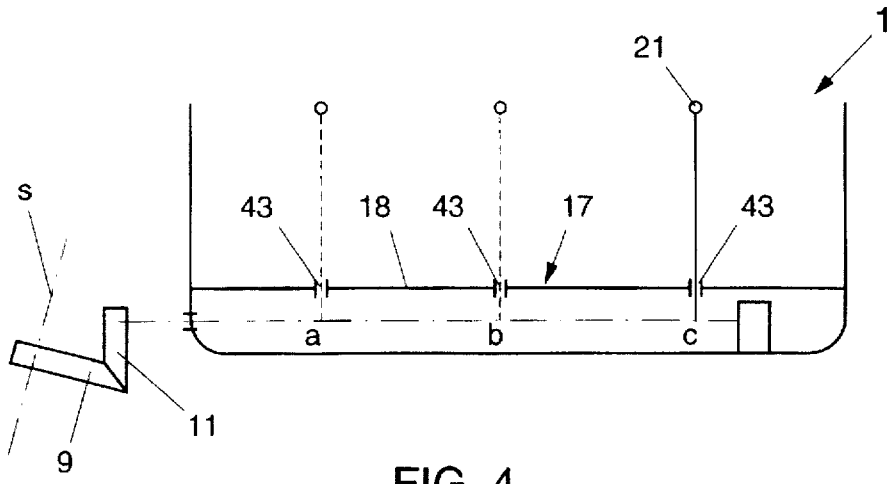
FIG. 4 is a schematic section in longitudinal direction through the vessel, with the operating handle being mountable on the operating handle pivot shaft in different positions.

FIG. 4 shows a particular embodiment of the steering device according to the invention. In this case, the vessel 1 is a sailboat comprising a cockpit 17, with the operating handle pivot shaft 13 extending under tie entire cockpit bottom 18. Via slots 43 in the cockpit bottom 18 the operating handle 21 can be mounted at different positions a, b, c distributed along the length of the operating handle pivot shaft 13, which provides the advantage that the steering device is very flexible and easily adjustable to the helmsman's wishes relating, for instance, to the weather conditions.

Fig. G shows an embodiment in which the vessel comprises two rudders whose pivot shafts 5 are coupled with each other via a linkage 45, so that the rudders 3 take the same positions. The two rudders 3 can be controlled by means of one or two operating handles 21.

It will be clear that the invention is not limited to the exemplary embodiments described, but that various modifications are possible within the scope of the invention. Thus, for instance, other transmission mechanisms, such as a cardan or a rack coupling are conceivable. Other embodiments for the operating handle are also possible.

I claim:

1. A steering device for a sailing vessel comprising at least one rudder arranged to pivot about a substantially vertically extending rudder pivoting axis and comprising at least one operating handle mounted on an operating handle pivot shaft extending in the longitudinal direction of the vessel for limited pivotal movement in an oblique arc, said arc being in a plane extending substantially vertically and transversely to the longitudinal axis of the vessel, the operating handle being connected to the rudder via at least one coupling mechanism, so that a pivotal movement of the operating handle causes a pivotal movement of the rudder about the rudder pivoting axis, characterized in that the coupling mechanism is formed by a set of cooperating gear segments, of which a first one is mounted on the rudder or a rudder pivot shaft connected thereto, and the second one is mounted on the at least one operating handle pivot shaft, said operating handle pivot shaft being fixedly connected to the operating handle for following rotational movement therewith.

2. A steering device according to claim 1, wherein the gear segments are designed as conical gear segments, the second gear segment meshing with an upwardly directed side of the first gear segment.

3. A steering device according to claim 1, characterized in that the gear segments are made of plastic.

4. A steering device according to claim 1, wherein the operating handle comprises a hinge fixable in different positions, said hinge having a hinge pin in or adjacent said plane and extending horizontally and perpendicularly to the longitudinal direction of the vessel, so that the angle (α) of the plane relative to a horizontal plane is adjustable.

5. A steering device according to claim 1, characterized in that the vessel is a sailboat comprising a cockpit with a cockpit bottom, the at least one operating handle pivot shaft extending under the cockpit bottom.

6. A steering device according to claim 5, wherein the operating handle pivot shaft extends along the entire length of the cockpit.

7. A steering device according to claim 6, further including an operating handle mountable at different positions (a, b, c) distributed along the length of the at least one operating handle pivot shaft.

8. A steering device according to claim 1, wherein the device comprises means for exerting a force on the steering device, which urge the rudder and the operating handle into the neutral position (N).

9. A steering device according to claim 8, wherein said force exerting means are formed by a stabilization weight connected to the at least one operating handle.

10. A steering device according to claim 8, characterized in that said means are formed by springs.

11. A steering device according to claim 1, characterized in that the device comprises at least one seat for the operator of the vessel, which seat, viewed in the longitudinal direction of the vessel, is arranged behind the operating handle.

12. A steering device according to claim 11, characterized in that adjacent the seat further an operating element for a motor is provided.

13. A steering device according to claim 1, characterized in that the operating handle comprises and extension member or joystick, by which the operating handle is remotely operable and fixable in a position.

14. The steering device of claim 1, wherein the operating handle is made of stainless steel tubes, a first end of the operating handle being connected to the operating handle pivot shaft, and a second free end of the operating handle being provided with a grip part in the shape of a segment of a circle.

* * * * *